US005956786A

United States Patent [19]

Huang

[11] Patent Number: 5,956,786

[45] Date of Patent: Sep. 28, 1999

[54] PLAYPEN

[75] Inventor: Li-Chu Chen Huang, Chiayi, Taiwan

[73] Assignee: Discovery International Co., Ltd., Tortola, Virgin Islands (Br.)

[21] Appl. No.: 09/013,925

[22] Filed: Jan. 27, 1998

[51] Int. Cl.[6] ..... A47D 9/02

[52] U.S. Cl. ..... 5/105; 5/106; 403/329

[58] Field of Search ..... 5/101, 102, 103, 5/104, 105, 106, 107, 108; 297/260.1, 259.1, 271.5, 271.6; 403/389, 231, 403, 205, 327, 329, 316, 22

[56] References Cited

U.S. PATENT DOCUMENTS

| | | | |
|---|---|---|---|
| 287,721 | 10/1883 | Ranney | 5/106 |
| 744,993 | 11/1903 | Barta | 5/106 X |
| 2,389,899 | 11/1945 | Deddo | 403/22 |
| 3,338,605 | 8/1967 | Stoeber | 403/205 X |
| 3,426,367 | 2/1969 | Bradford | 403/329 X |
| 4,247,216 | 1/1981 | Pansini | 403/329 X |
| 5,387,048 | 2/1995 | Kuo | 403/329 X |
| 5,485,655 | 1/1996 | Wang | 5/98.1 X |
| 5,590,974 | 1/1997 | Yang | 403/329 X |
| 5,779,386 | 7/1998 | Eichhorn | 403/329 |

FOREIGN PATENT DOCUMENTS

| | | | |
|---|---|---|---|
| 240268 | 10/1925 | United Kingdom | 5/102 |

*Primary Examiner*—Terry Lee Melius
*Assistant Examiner*—Robert G. Santos
*Attorney, Agent, or Firm*—Bacon & Thomas, PLLC

[57] ABSTRACT

The present application provides an improved playpen that can be transformed into a rocking cradle. The playpen becomes a rocking cradle due to pivoting arcuate tubes fitted to a bottom of the playpen. Therefore, it is easier for the parents to coax infant to sleep comfortably in that type of the playpen. More importantly, the arcuate tubes can readily be pivoted to their first configuration whereby the rocking cradle is converted back into the conventional playpen.

9 Claims, 5 Drawing Sheets

PLAYPEN

FIELD OF THE INVENTION

The present application relates to a playpen, and more particularly relates to an improved playpen having a pair of pivotable rocker devices enabling the playpen to convert to a rocking cradle easily and vice versa.

BACKGROUND OF THE INVENTION

The main structure of prior art playpens includes four top rails contiguously linked by four top corner brackets, four bottom rails contiguously linked by four bottom brackets, four columns respectively extending between paired top and bottom corner brackets, a base extending between the bottom side rails and a mesh wall extending around the four columns. The top side rails and bottom side rails may be articulated at midpoints thereof to facilitate easy and compact storage of the playpen when not in use. However, the bottom corner brackets of prior art playpens also function as simple feet which, although providing stability do not allow the playpen to be rocked when a baby or infant therein is tired and should sleep.

In order to coax an infant into sleeping, the parents usually cradle the infant in their arms. However, the parents' arms ache after five or ten minutes of this action. When the parent places the infant on the floor of conventional playpen, the infant usually wakes up and cries which is inconvenient and distressing. The present application provides a creative and novel means for solving the problems mentioned above.

SUMMARY OF THE INVENTION

It is an object of the present application to provide an improved playpen that can be transformed into a rocking cradle. The main characteristic of the present application is to pivot a pair of rocker devices to support the playpen. Therefore, the playpen becomes the rocking cradle and it is easier for the parents to coax an infant to sleep comfortably in that type of the playpen. More important, the rocker devices can readily be pivoted to the first configuration whereby the rocking cradle is converted back to the conventional playpen.

It is an object of the present application to provide an improved playpen with a pair of rocker devices which includes a pair of couplings, a pair of pivots and an arcuate tube. In a first position, the rocking devices are pivoted to rest at a point above the bottom faces of the bottom corners brackets. In a second position, the arcuate tubes are pivoted downward such that they extend below the bottom faces of the bottom corner brackets whereby the playpen becomes a rocking cradle. When desired, the rocking cradle can be returned to function as the playpen by reversing the procedure described.

It is a further object of the present invention to provide rocker devices to the playpen which are detachable therefrom so that the playpen may be folded when not in use.

It is another object of the present application to provide an improved playpen wherein a V-shaped leaf spring is secured by the first rivet within each end of the straight ends of the arcuate tube.

The foregoing advantages and objects of the invention will be understood more clearly when taken in light of drawings of the present application.

DETAILED DESCRIPTION OF THE INVENTION

Figure 1:
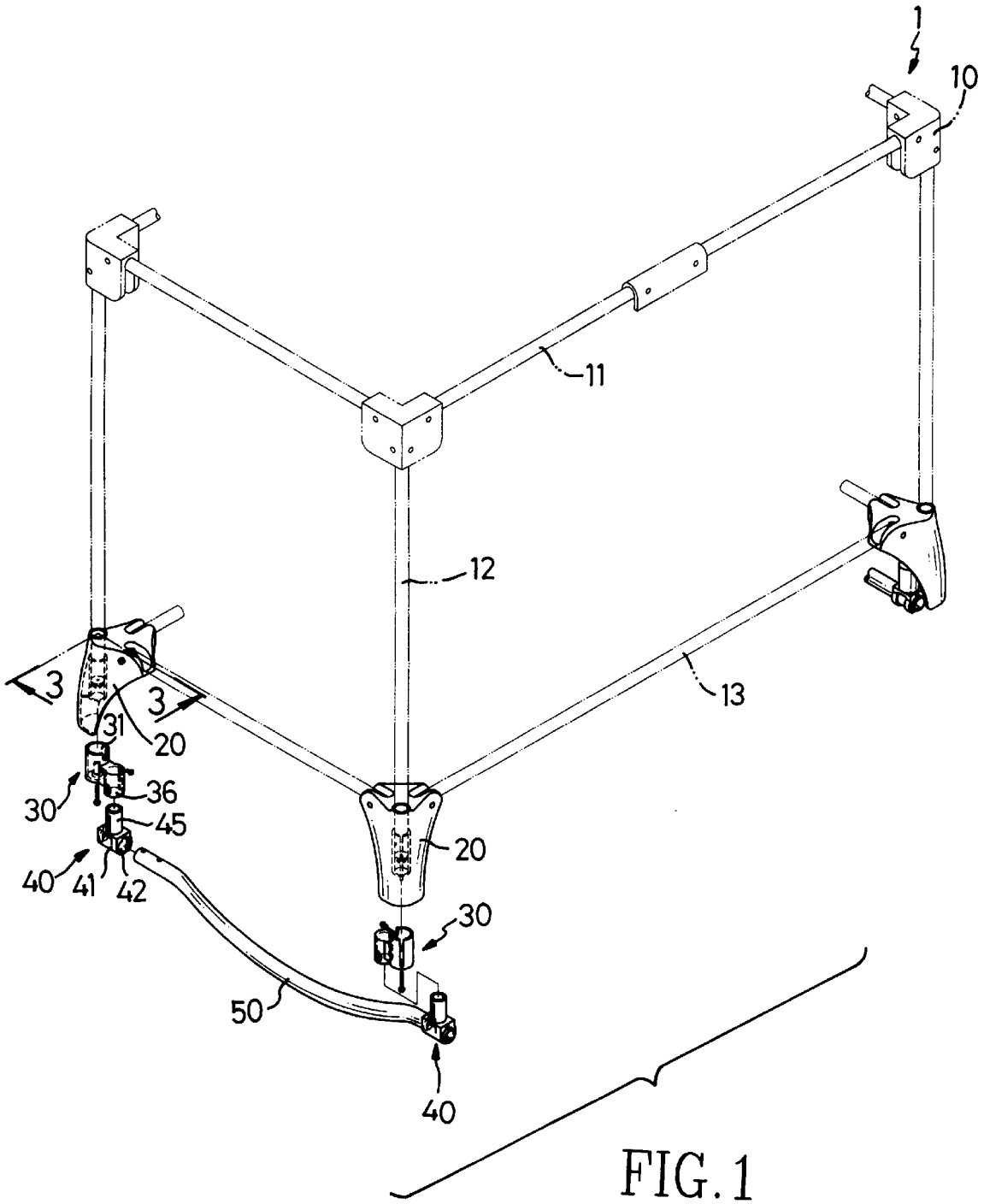
FIG. 1 is a partial perspective view of a playpen according to the present application.

As shown in FIG. 1, a playpen 1 convertible to a rocking cradle includes four top corner brackets 10, four top rails 11 each connected between two corresponding top corner brackets 10, four columns 12 having a top end secured to a corresponding top corner bracket 10 and extending downwardly therefrom, four bottom corner brackets 20 attached to a second end of a respective one of the columns 12, four bottom rails 13 each connected between two corresponding bottom brackets 20 and a pair of rocking devices attached respectively to two opposed pairs of the bottom comer brackets 20.

The pair of rocker devices are identical, and thus the components thereof and attachment to the respective bottom comer brackets 20 are referred to hereinafter as a single unit. Similarly, the four bottom corner brackets 20 are identical so only a single unit is referred to here on.

Figure 2:
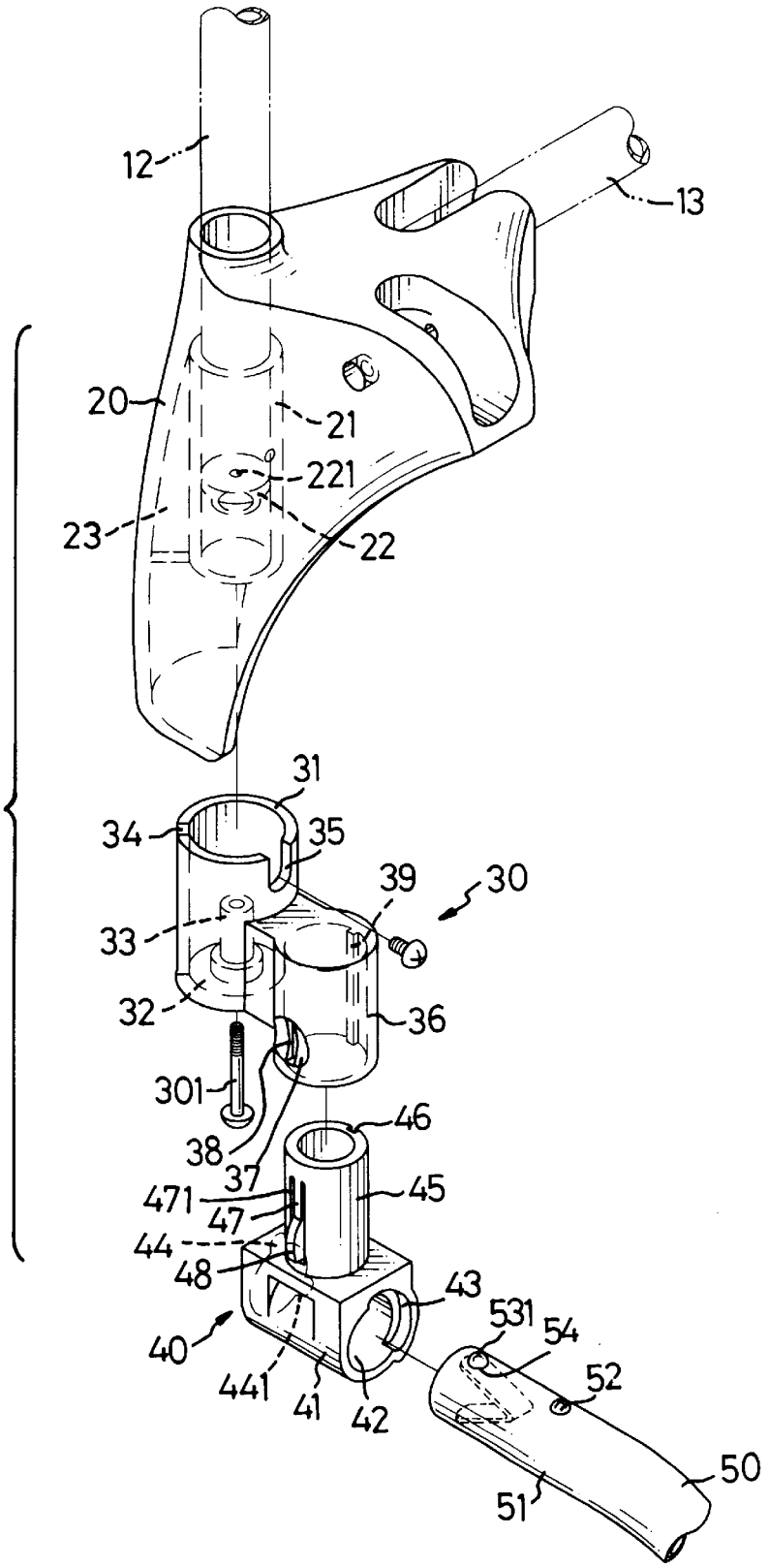
FIG. 2 is an exploded perspective view of the bottom corner bracket, the coupling and the pivot of a playpen according to the present application.

As shown in FIG. 2, the bottom comer bracket 20 includes a top plate and a hollow portion extending downwardly from the top plate. Two recesses are defined in a top face of the top plate and are perpendicular to each other. An end of a respective one of the bottom rails 13 is received in each of the two recesses of the bottom corner brackets 20. A tubular projection is integrally formed within the hollow portion of the bottom comer bracket 20 and defines a passage 21 therein extending up through the top plate. The passage 21 has a longitudinal axis perpendicular to the longitudinal axes of the bottom rails 13 received in the recess of the bottom corner bracket 20. An integral platform 22 is formed in a lower portion of the passage 21 and divides the passage 21 into an upper part and a lower part. The integral platform 22 defines a screwhole 221 in a center thereof. The upper part of the passage 21 is sized to snugly receive therein a lower end of the column 12 such that a bottom face thereof abuts a top face of the integral platform 22.

A web 23 extends from an outer circumferential periphery of the tubular projection to an inner face of the hollow portion of the bottom corner bracket 20.

Each rocker device includes a pair of couplings 30, a pair of pivots 40 and an arcuate tube 50. As the couplings 30 are identical, only one unit is described from hereon. The coupling 30 is substantially shaped as "∞" when viewed from a horizontal cross-sectional and is divided into a first socket 31 integrally formed with a second socket 36 adjacent thereto. The first socket 31 has a circumferential wall defining an opening at a top thereof and a base 32 is integrally formed at a bottom thereof. A top face of the base 32 has formed thereon a rod 33 which is upright. A bottom face of the base 32 has defined therein a counter bore in communication with a bore extending upward through the rod 33. A cylindrical space is defined between an inner periphery of the circumferential wall and the rod 33. The cylindrical space of the first socket 31 is sized to receive a lower portion of the tubular projection. A bolt 301 extends through the counter bore and the bore of the first socket 31 to threadedly engage with the platform 22 of the bottom corner bracket 20. A long notch 34 is longitudinally defined in the circumferential wall of the first socket 31 and is in communication with the opening thereof. The long notch 34 is sized to matingly engage with the web 23 of the bottom corner bracket 20.

Figure 3:
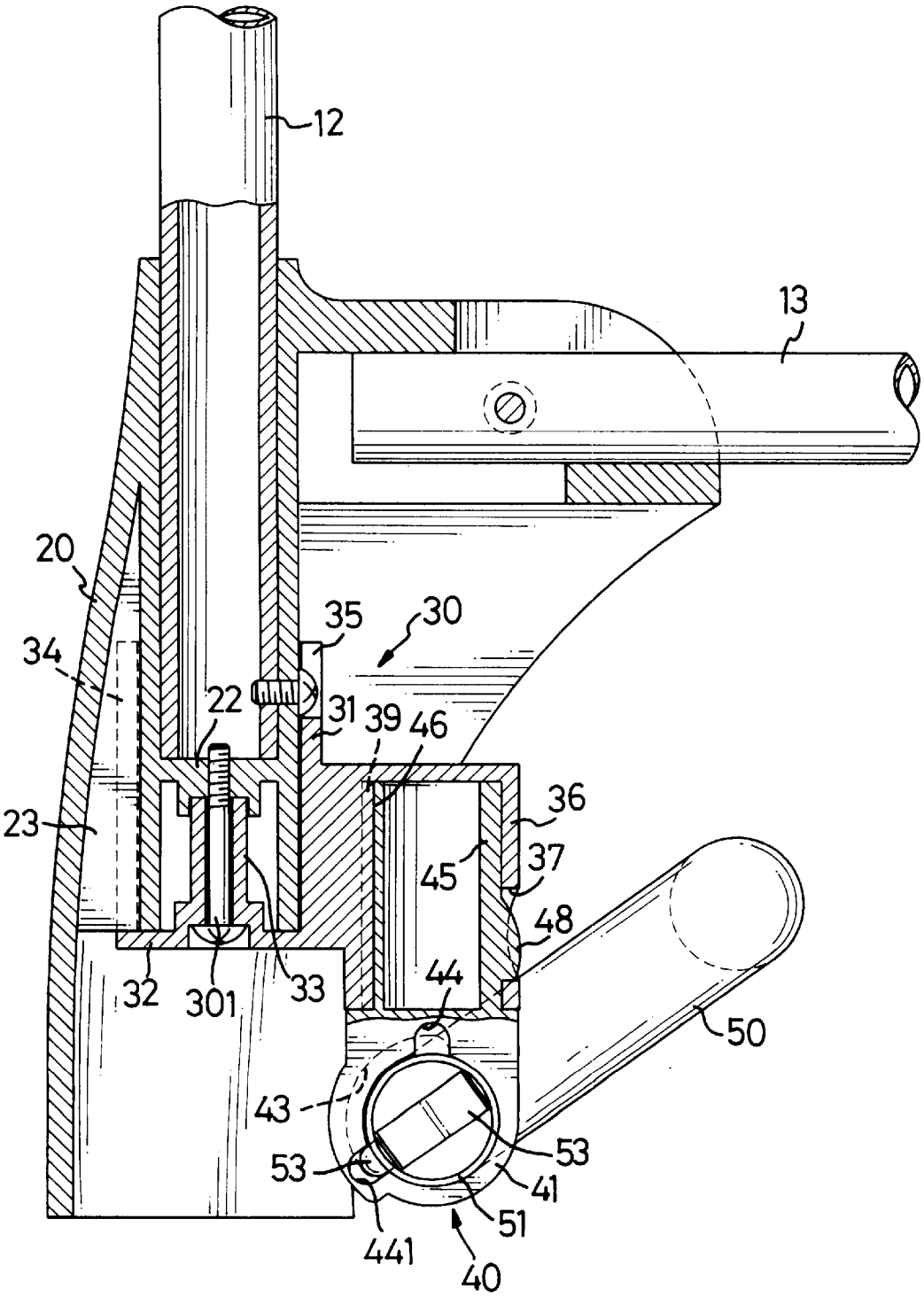
FIG. 3 is a cross-sectional view taken along the line 3—3 of FIG. 1.
Figure 4:
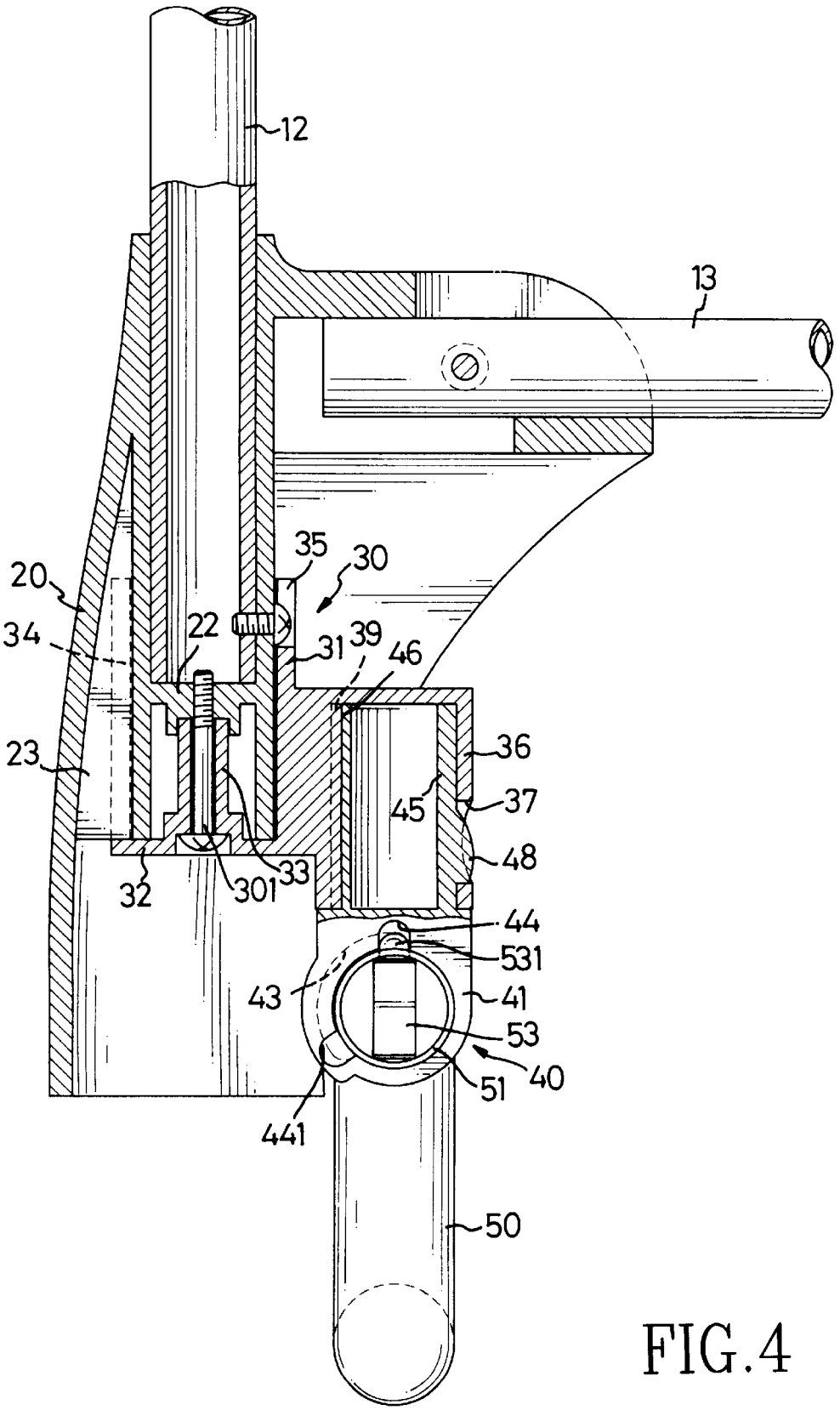
FIG. 4 is a cross-sectional view of embodiment taken along the line 3—3 of FIG. 1.

A short notch 35 is also defined in the circumferential wall of the first socket 31 and is in communication with the opening thereof. A screw extends through the short notch 35 and a sidewall of the tubular projection to threadedly engage with a sidewall of the column 12. By means of the bolt, the screw and the engagement between the web 23 and the long notch 34, the coupling 30 is securely attached to the bottom corner bracket 20 and the column 12 as seen in FIG. 3 and FIG. 4.

The second socket 36 includes a cylindrical recess with an open bottom and a closed top. A ridge 39 extends along an inner periphery defining the cylindrical recess from the closed top to the open bottom. A slot 38 is defined through a sidewall of the second socket 36 and near the open bottom thereof. The slot 38 is in a position diametrically opposed to the ridge 39.

The pivot 40 is substantially shaped as an inverted "T" and includes a tubular top 45 integrally formed with a base 41. The tubular top 45 is sized to be slidingly received in the cylindrical recess of the second socket 36. A top face of the tubular top 45 abuts a bottom face of the closed top of the second socket 36. A groove 46 is longitudinally defined down an outside periphery of the tubular top 45 and is sized to receive the ridge 39 of the second socket 36 therein.

A resilient member 47 is defined by a U-shaped channel 471 and has an outwardly protruding tip 48 integrally formed near a bottom of the tubular top 45. The protruding tip 48 is dimensioned to extend through the slot 38 of the second socket 36 when the tubular top 45 is received in the cylindrical recess of the second socket 36. The base 41 of the pivot 40 includes a cylindrical aperture 42 which extends in a direction perpendicular to the tubular top 45. The base 41 defines a first keyway 44 and a second keyway 441, each in communication with the cylindrical aperture 42 and extending along the entire length thereof. As seen in FIG. 3, the first keyway 44 is set at a position of 12 o'clock and the second keyway 441 is set at a position of 8 o'clock.

The arcuate tube 50 has two straight ends 51 and an arcuate main portion extending integrally between the two straight ends 51. Each straight end 51 of the arcuate tube 50 is sized to be slidingly received in the cylindrical aperture 42 of the pivot 40. One of two springs 53, such as a V-shaped leaf spring as preferred in this embodiment, is secured within each of the straight ends 51 of the arcuate tube 50 and has a first protuberance 531 extending therefrom and sized to extend through and protrude from a hole 54 defined in a sidewall of the straight end 51. The first protuberance 531 is sized to be received in either the first keyway 44 or second keyway 441 at one time. A second protuberance 52 protrudes from the outer periphery of the straight portion 51 of the arcuate tube 50 closer to the main arcuate portion and in line with the head of the first protuberance 531.

Figure 5:
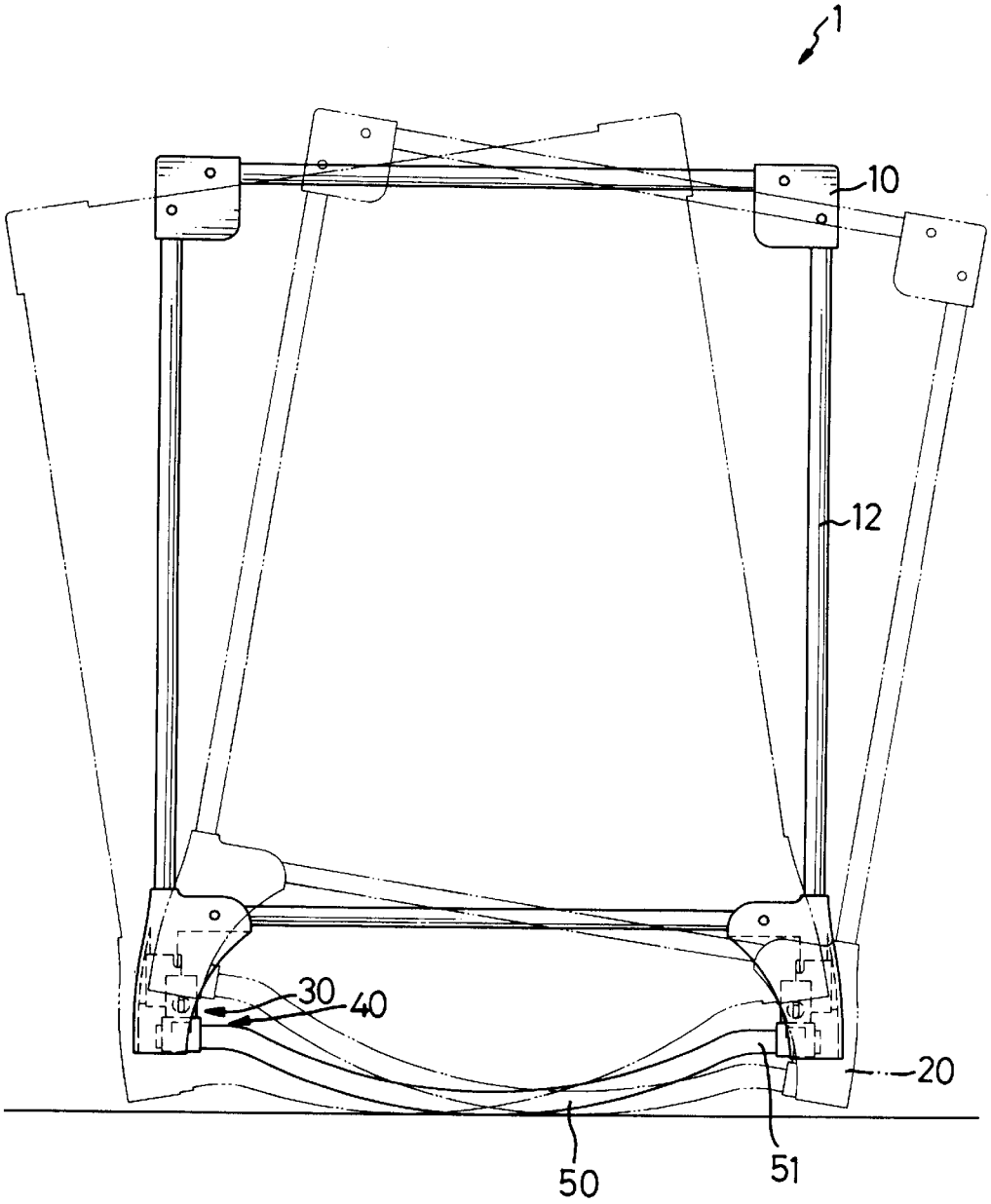
FIG. 5 is a side view of an embodiment after pivoting the arcuate tube according to the present application.

FIG. 4 illustrates that in the embodiment of the invention, the arcuate tube 50 can be pivoted to support the whole playpen, e.g. the rocking cradle. As shown in FIG. 5, when the arcuate tube 50 placed in the right place, the parents can readily rocker playpen at any time.

It will be understand that the scope of the invention and of the claims is not limited by the illustrated embodiments, but extends to the equivalent structure as well. To remove the rocker devices from the bottom corner brackets 20 so that the playpen may be folded for storage, a user presses inward each resilient member 47 to release engagement with the second socket 36 via the slot 38 whereby the pivot 40 can be disengaged from the coupling 30.

I claim:

1. An improved playpen arranged to be easily converted into a rocking cradle, and also to be easily converted from a rocking cradle back into a playpen, comprising:

four bottom corner brackets;

a pair of arcuate tubes including an arcuate main portion; and pivots connected between each end of the arcuate tubes and respective ones of the four bottom corner brackets, said pivots being arranged to permit said arcuate tubes to be pivoted between a first position in which the arcuate main portion is situated above lower surfaces of said brackets, and a second position in which the arcuate main portion is situated below lower surfaces of said brackets, whereby when said tube is pivoted to said first position, said playpen is supported by said lower surfaces of said brackets, and when said tube is pivoted to said second position, said arcuate main portion of said arcuate tube supports said playpen and said playpen therefore is converted into a rocking cradle.

2. An improved playpen as claimed in claim 1, wherein each bracket includes two perpendicular recesses for receiving two playpen supporting rails in a same plane.

3. An improved playpen as claimed in claim 2, wherein each of the four bottom brackets includes a hollow portion arranged to receive a column perpendicular to said plane.

4. An improved playpen as claimed in claim 1, wherein each of said brackets includes two vertical recesses and each of said pivots comprises a base and a tubular top integrally formed with the base and positioned in one of said vertical recesses.

5. An improved playpen as claimed in claim 4, wherein a base of the pivot includes a cylindrical aperture which extends in a direction perpendicular to the tubular top and defines and defines two keyways, wherein one of the straight ends of one of the arcuate tubes is received in the cylindrical aperture.

6. An improved playpen as claimed in claim 1, wherein the arcuate tube comprises two straight ends and said arcuate main portion extends integrally between said two ends.

7. An improved playpen as claimed in claim 1, further comprising a v-shaped leaf spring secured to a straight end of the arcuate tube by at least one protuberance.

8. An improved playpen as claimed in claim 7, wherein said at least one protuberance is received in a keyway in a base of the pivot.

9. An improved playpen as claimed in claim 1, wherein said arcuate tube is arranged to be rotated through an angle by a user.

* * * * *